US011554413B2

(12) United States Patent
Petrus et al.

(10) Patent No.: US 11,554,413 B2
(45) Date of Patent: Jan. 17, 2023

(54) HYBRID CAM BORE SAND CORE WITH METAL CHILLS FOR CAST ALUMINUM BLOCK

(71) Applicant: GM Global Technology Operations LLC, Detroit, MI (US)

(72) Inventors: Ronald J. Petrus, Lake Orion, MI (US); Qigui Wang, Rochester Hills, MI (US); Richard M. Nichols, III, Macomb, MI (US); Brian C. Leuenhagen, Clarkston, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 73 days.

(21) Appl. No.: 17/163,926

(22) Filed: Feb. 1, 2021

(65) Prior Publication Data

US 2022/0241851 A1 Aug. 4, 2022

(51) Int. Cl.

| | |
|---|---|
| ***B22D 15/02*** | (2006.01) |
| ***B22D 15/04*** | (2006.01) |
| ***B22C 9/10*** | (2006.01) |
| ***F02F 1/00*** | (2006.01) |

(52) U.S. Cl.

CPC ..... *B22D 15/04* (2013.01); *B22C 9/10* (2013.01); *F02F 1/00* (2013.01); *F02F 2200/06* (2013.01)

(58) Field of Classification Search

CPC ..... B22C 9/10; B22C 9/103; B22C 9/108; B22C 9/24; B22D 15/00; B22D 15/02; B22D 15/04; B22D 27/04; F02F 1/00; F02F 2200/06

USPC ..... 164/369, 137, 122, 125, 127

See application file for complete search history.

(56) References Cited

U.S. PATENT DOCUMENTS

| | | | | |
|---|---|---|---|---|
| 5,280,822 | A * | 1/1994 | Bullock | B22C 9/10 164/369 |
| 2002/0007931 | A1* | 1/2002 | Crafton et al. | B22D 15/00 164/352 |
| 2006/0042774 | A1* | 3/2006 | Newcomb et al. | B22D 15/02 164/355 |
| 2006/0048911 | A1* | 3/2006 | Newcomb | B22D 19/0009 164/98 |
| 2007/0163744 | A1* | 7/2007 | Douro et al. | B22D 19/0009 164/369 |
| 2011/0094701 | A1* | 4/2011 | Sundarraj et al. | B22D 15/02 164/137 |

FOREIGN PATENT DOCUMENTS

| | | |
|---|---|---|
| DE | 610071 C | 3/1935 |
| DE | 60307467 | 1/2007 |

* cited by examiner

*Primary Examiner* — Kevin P Kerns
(74) *Attorney, Agent, or Firm* — Vivacqua Crane PLLC

(57) ABSTRACT

A system for making a hybrid cam bore sand core with metal chills for an engine block includes an engine block cast of an aluminum material. A camshaft bore extends through the engine block. A cam bore sand core with at least one metal chill is positioned within the camshaft bore. A body portion of the at least one metal chill is positioned in direct contact with a cam bearing surface of at least one cam bearing member during casting of the engine block to increase a cooling rate of the at least one cam bearing member and create a crystalline material depth of the cam bearing member having enhanced mechanical properties.

20 Claims, 6 Drawing Sheets

HYBRID CAM BORE SAND CORE WITH METAL CHILLS FOR CAST ALUMINUM BLOCK

GOVERNMENT LICENSE RIGHTS

This invention was made with government support under Contract No. DE-EE0008877 awarded by the U.S. Department of Energy. The government has certain rights in the invention.

INTRODUCTION

The present disclosure relates to cast engine blocks and methods for casting engine blocks.

Automobile vehicle engine blocks may be cast from metals such as iron and aluminum. The use of aluminum reduces a weight of the engine block compared to iron and therefore reduces vehicle weight which provides improved fuel efficiency for the vehicle. The mechanical properties of aluminum are not equivalent to those of iron, therefore processes have been developed to locally enhance the mechanical properties of aluminum in high load areas of the engine block, particularly in the areas of the crankshaft and crankshaft bearing journals.

Casting molds commonly use casting sand to define a negative volume defining a desired geometry for the metal to be subsequently poured into the mold. It is desirable in aluminum casting to locally enhance the mechanical properties of the aluminum in areas of increased loading such as at the crankshaft bearing journals. It is known that increasing a cooling rate of the aluminum provides localized enhancement of the mechanical properties of the aluminum. Casting sand however acts as a thermal insulator which retards the cooling rate of aluminum at the areas of contact of the casting sand with the aluminum. Casting "chills" are therefore introduced into the mold prior to pour which are made of a material such as iron having a heat transfer coefficient that enhances a cooling rate of the aluminum at the contact locations of the aluminum and the chill. Known chills extend for an entire length of the engine block in an area of the crankshaft bearing journals, which are subsequently removed from the mold after the cast aluminum cools. A geometry of the camshaft area of known engine block designs inhibits the removal of chills in the camshaft journal bearing areas, therefore enhancement of the aluminum material at the camshaft journal bearings has through the use of chills not been achievable. Such enhancement would permit increased horsepower output from the engine with no weight penalty.

Thus, while current aluminum engine block casting processes achieve their intended purpose, there is a need for a new and improved system and method for casting aluminum engine blocks.

SUMMARY

According to several aspects, a system for making a hybrid cam bore sand core with metal chills for an automobile vehicle engine block includes an automobile vehicle engine block cast of an aluminum material. A camshaft bore extends through the engine block. A cam bore sand core with at least one metal chill is positioned within the camshaft bore. A body portion of the at least one metal chill is positioned in direct contact with a cam bearing surface of at least one cam bearing member during casting of the engine block to increase a cooling rate of the at least one cam bearing member and create a crystalline material depth of the cam bearing member having enhanced mechanical properties.

In another aspect of the present disclosure, the at least one metal chill defines a first metal chill and a second metal chill individually having an outward directed body portion, an inward directed body end, and a connecting body portion positioned between the inward directed body end and the outward directed body portion.

In another aspect of the present disclosure, the outward directed body portion includes a first tapering surface positioned to directly contact the cam bearing surface of a first one of the at least one cam bearing member.

In another aspect of the present disclosure, the inward directed body end includes a second tapering surface positioned to directly contact the cam bearing surface of a second one of the at least one cam bearing member.

In another aspect of the present disclosure, the first tapering surface defines a first angle with respect to a horizontal plane and the second tapering surface defines a second angle with respect to a second horizontal plane.

In another aspect of the present disclosure, the connecting body portion includes a smaller diameter inward directed body end and a larger diameter of the outward directed body portion.

In another aspect of the present disclosure, a first sand core surrounds the connecting body portion of the first metal chill and a second sand core surrounds the connecting body portion of the second metal chill.

In another aspect of the present disclosure, a first extension member is integrally created on the inward directed body end of the first metal chill and a second extension member integrally is created on the inward directed body end of the second metal chill.

In another aspect of the present disclosure, a third sand core is positioned between the first metal chill and the second metal chill, the first extension member is embedded in and retains the third sand core in contact with the inward directed body end of the first metal chill during molding, and the second extension member is embedded in and retains the third sand core in contact with the inward directed body end of the second metal chill during molding.

In another aspect of the present disclosure, the first metal chill is removed from the camshaft bore after molding in a first direction and the second metal chill is removed from the camshaft bore in a second direction opposite to the first direction.

According to several aspects, a system for making a hybrid cam bore sand core with metal chills for an automobile vehicle engine block includes an automobile vehicle engine block casting of an aluminum material. A camshaft bore extends through the engine block casting. A cam bore sand core with a first metal chill and a second metal chill is positioned within the camshaft bore during pouring of the engine block casting. A body portion of the first metal chill is positioned in direct contact with a cam bearing surface of a first cam bearing member during pouring of the engine block casting and a body portion of the second metal chill positioned in direct contact with a cam bearing surface of a second bearing member during pouring of the engine block casting. The first metal chill and the second metal chill are provided of a metal to increase a cooling rate of the aluminum material and to create a crystalline material depth of the first cam bearing member and the second cam bearing member having enhanced mechanical properties. The body portion of the first metal chill includes a first tapering surface and the body portion of the second metal chill includes a second tapering surface, the first tapering surface and the second tapering surface allowing sliding removal of the first metal chill in a first direction and sliding removal of the second metal chill in a second direction opposite to the first direction.

In another aspect of the present disclosure, the first metal chill and the second metal chill individually include an inward directed body end and a connecting body portion positioned between the inward directed body end and the body portion.

In another aspect of the present disclosure, the inward directed body end includes a third tapering surface defining an angle.

In another aspect of the present disclosure, the first metal chill and the second metal chill further include a central body portion directly connected to the body portion via a first connecting body portion and an inward directed body end integrally connected to the central body portion by a second connecting body portion.

In another aspect of the present disclosure, the inward directed body end of the first metal chill is in direct contact with the inward directed body end of the second metal chill.

In another aspect of the present disclosure, the inward directed body end of the first metal chill is separated from the inward directed body end of the second metal chill by a gap.

In another aspect of the present disclosure, the inward directed body end of the first metal chill and the inward directed body end of the second metal chill are in direct contact with a portion of a cam bearing surface of a third cam bearing member.

According to several aspects, a method for making a hybrid cam bore sand core with metal chills for a cast aluminum engine block includes: preparing an automobile vehicle engine block mold negative portion having a sand core; positioning a cam bore sand core with at least one metal chill within a camshaft bore of the sand core; and casting an automobile vehicle engine block from an aluminum material using the engine block mold negative having a body portion of the at least one metal chill in direct contact with a cam bearing surface of at least one cam bearing member during the casting of the engine block to increase a cooling rate of the at least one cam bearing member and to create a crystalline material depth of the cam bearing member having enhanced mechanical properties.

In another aspect of the present disclosure, the method further includes forming the at least one metal chill as a first metal chill and a second metal chill further individually having an inward directed body end and a connecting body portion positioned between the inward directed body end and the body portion.

In another aspect of the present disclosure, the method further includes forming the at least one metal chill as a first metal chill and a second metal chill further individually having a central body portion directly connected to the body portion via a first connecting body portion and an inward directed body end integrally connected to the central body portion by a second connecting body portion.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
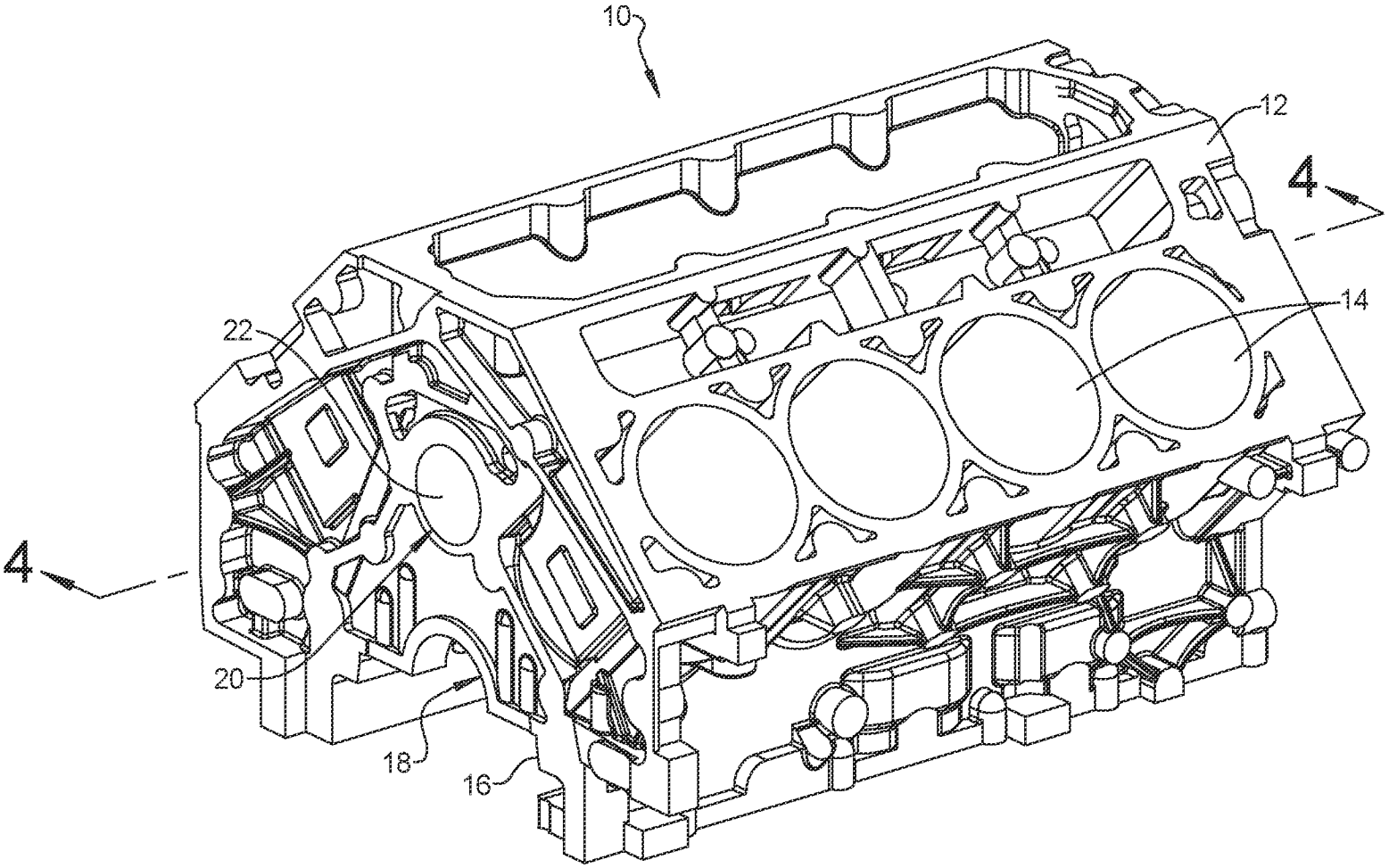
FIG. 1 is a front elevational perspective view of an as-cast engine block according to an exemplary aspect.

Referring to FIG. 1, a system and method for making a hybrid cam bore sand core with metal chills for a cast aluminum engine block 10 includes an aluminum as-cast engine block 12. The as-cast engine block 12 is shown prior to machining and includes multiple cylinder bores 14 and a crankcase cavity 16 having multiple crankshaft bearing supports 18 (only one is visible in this view). According to several aspects, the as-cast engine block 12 includes a camshaft bore 20 with a cam bore sand core with metal chills 22 positioned within the camshaft bore 20, shown after casting and prior to removal of the cam bore sand core with metal chills 22. The cam bore sand core with metal chills 22 is further discussed in reference to FIGS. 2 and 4 through 6.

Referring to FIG. 2 and again to FIG. 1, a mold negative portion 24 is shown which is formed within an engine block mold (not shown) prior to pour of a molten aluminum into the mold. The mold negative portion 24 includes a crankcase sand core 26 with a crankshaft chill 28 extending throughout a lower portion of the crankcase sand core 26. After the aluminum pour into the mold is complete with aluminum cooling and crystallization which produces the as-cast engine block 12 discussed in reference to FIG. 1, the crankcase sand core 26 is broken apart and removed from the as-cast engine block 12 and the crankshaft chill 28 is removed for example in a downward direction 30 for reuse.

The mold negative portion 24 further includes the cam bore sand core with metal chills 22. According to several aspects, the cam bore sand core with metal chills 22 includes a camshaft sand core 32 together with a first metal chill 34 and a second metal chill 36. After the aluminum pour and aluminum cooling and crystallization, the camshaft sand core 32 is broken apart and removed from the as-cast engine block 12 and the first metal chill 34 and the second metal chill 36 are individually slidably removed from the as-cast engine block 12 as discussed in further detail in reference to FIG. 4 for reuse.

Figure 2:
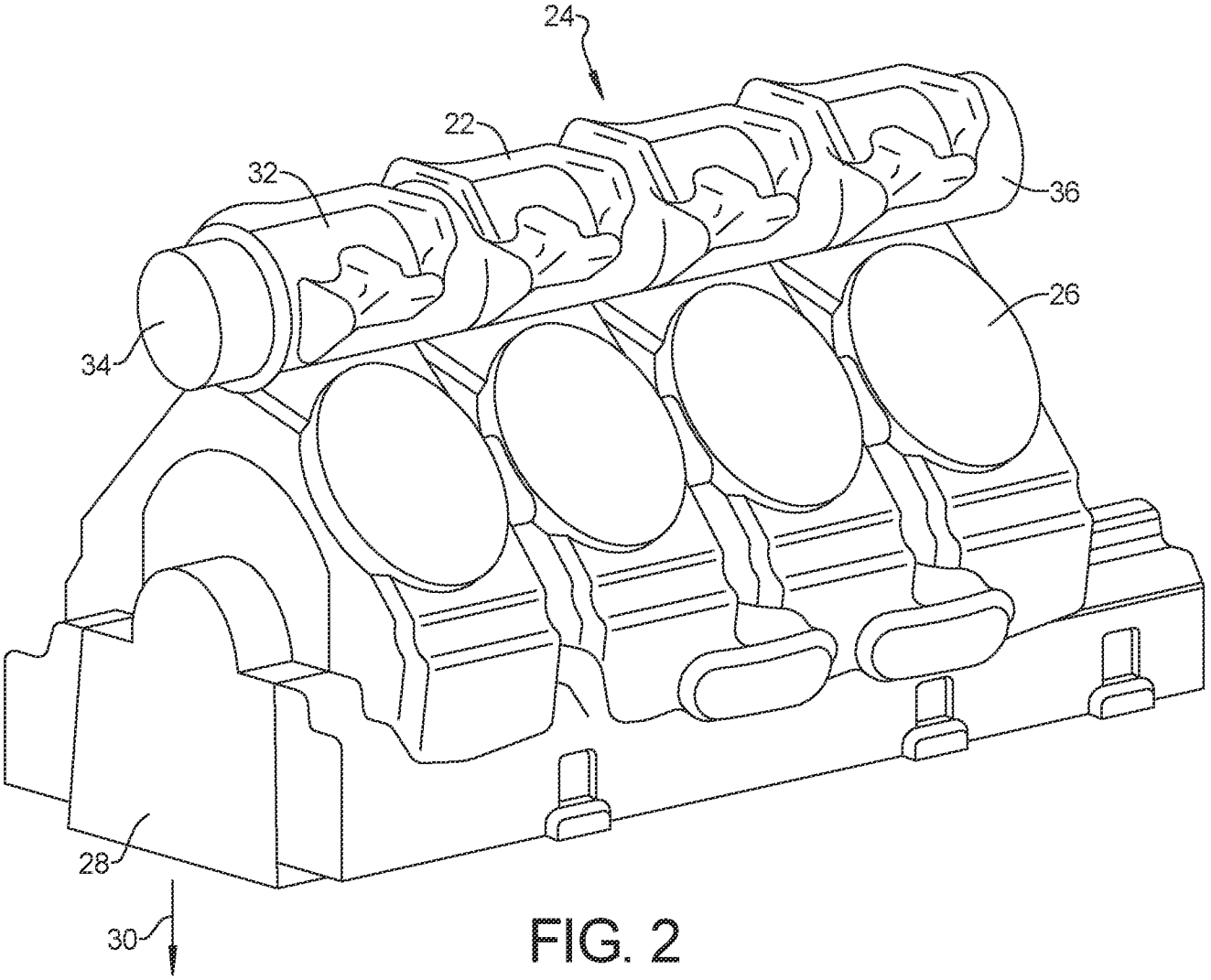
FIG. 2 is a front elevational perspective view of a crankcase mold negative portion used during molding of the as-cast engine block of FIG. 1.

Referring to FIG. 3 and again to FIGS. 1 and 2, the as-cast engine block 12 described in reference to FIG. 2 is shown after machining to produce a finished engine block 38. The finished engine block 38 includes multiple machined cylinder bores 40. The crankshaft bearing supports 18 are machined to receive multiple individual bearing journals 42, and multiple crankshaft bearing caps 44 are fastened onto the finished engine block 38 and are ready to receive a crankshaft (not shown). After finish machining of the camshaft bearing members in the camshaft bore 20, which are described in greater detail in reference to FIG. 5, multiple individual camshaft journal bearings 46 (only one is visible in this view) are installed. Multiple machined surfaces including a cylinder block deck surface 48 are also provided at this time.

Figure 3:
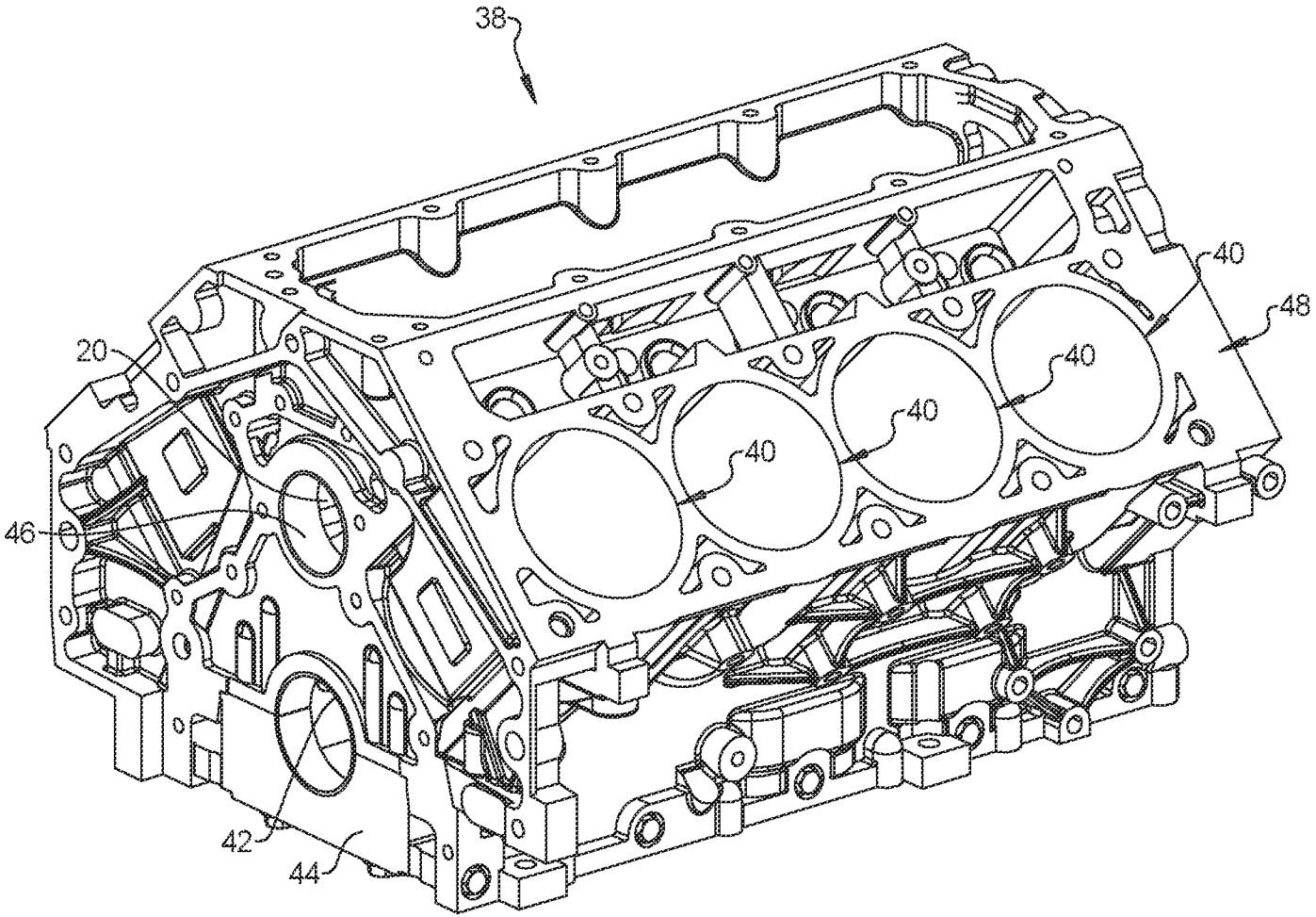
FIG. 3 is a front elevational perspective view of the as-cast engine block of FIG. 1 after machining.

Referring to FIG. 4 and again to FIGS. 2 and 3, according to several aspects the cam bore sand core with metal chills 22 includes the first metal chill 34 and the second metal chill 36. The first metal chill 34 includes a first metal chill body 50, and the second metal chill 36 includes a second metal chill body 52 which is substantially identical to the first metal chill body 50 and oppositely directed. The first metal chill body 50 and the second metal chill body 52 include an outward directed body portion 54, an inward directed body end 56, and a connecting body portion 58 positioned between the inward directed body end 56 and the outward directed body portion 54 and having a diameter smaller than a diameter of the inward directed body end 56 and a diameter of the outward directed body portion 54.

A first tapering surface 60 of the outward directed body portion 54 is positioned to directly contact a first cam bearing surface 62 of a first cam bearing member 64 during casting. The first cam bearing member 64 is created as the aluminum material cools in the mold. A second tapering surface 66 of the inward directed body end 56 is positioned to directly contact a second cam bearing member 68 created as the aluminum material cools in the mold to form the second cam bearing member 68. The second metal chill 36 is similarly created and includes a third tapering surface 70 positioned to directly contact a third cam bearing surface 72 and a fourth tapering surface 74 positioned to directly contact a fourth cam bearing surface 76.

A first sand core 78 surrounds the connecting body portion 58 of the first metal chill 34. A third sand core 80 is positioned between the first metal chill 34 and the second metal chill 36. A second sand core 82 surrounds a connecting body portion 58' of the second metal chill 36. According to several aspects, a first extension member 84 may be integrally created on the inward directed body end 56 of the first metal chill 34 and a second extension member 86 may be integrally created on an inward directed body end 56' of the second metal chill 36. The first extension member 84 is embedded in and helps retain the third sand core 80 in contact with the inward directed body end 56 during molding, and the second extension member 86 is embedded in and helps retain the third sand core 80 in contact with the inward directed body end 56' of the second metal chill 36 during molding.

To assist with removal of the first metal chill 34 from the as-cast engine block 12 after the aluminum casting material cools, a first release member 88 may be provided as an integral extension of the outward directed body portion 54. The first metal chill 34 is removed from the as-cast engine block 12 in a removal direction 90 by grasping or coupling a removal tool (not shown) to the first release member 88. Similarly, to assist with removal of the second metal chill 36 from the as-cast engine block 12 after the aluminum casting material cools, a second release member 92 may be provided as an integral extension of the outward directed body portion 54'. The second metal chill 36 is removed from the as-cast engine block 12 in a removal direction 94, opposite to the removal direction 90, by grasping or coupling a removal tool (not shown) to the second release member 92.

Referring to FIG. 5 and again to FIGS. 1 through 4, the first tapering surface 60 of the outward directed body portion 54 defines an angle alpha ($\alpha$) with respect to a horizontal plane 96. The first cam bearing surface 62 directly abuts the first tapering surface 60 during aluminum material pour and therefore permits an enhanced cooling rate of the first cam bearing surface 62 to a crystalline material depth 98 which creates enhanced mechanical properties of the first cam bearing surface 62 compared to aluminum material cooling at a normal cooling rate with air exposure or a retarded cooling rate if the aluminum is in contact with a sand core. Due to the crystalline material depth 98 of the first cam bearing surface 62, as the first cam bearing surface 62 is subsequently machined to be parallel with the horizontal plane 96 and to accept a bearing journal the enhanced mechanical properties of the first cam bearing surface 62 are retained.

According to several aspects, because the inward directed body end 56 is embedded between the first sand core 78 and the second sand core 80 which may retard a cooling rate of the second cam bearing member 68, the inward directed body end 56 may have a greater length than the outward directed body portion 54, which further enhances heat transfer between the inward directed body end 56 and the second cam bearing member 68. The inward directed body end 56 may therefore include a cylindrical portion 100 having a major diameter 102 which transitions into a conical portion 104 having a third tapering surface 106 which defines a portion of the second tapering surface 66. The third tapering surface 106 may define an angle beta ($\beta$) with respect to a horizontal plane 108. According to several aspects the angle $\beta$ may be equal to the angle $\alpha$ or may vary from the angle $\alpha$ as desired to enhance removal of the first metal chill 34 and the second metal chill 36. A second cam bearing surface 110 directly abuts the third tapering surface 106 during aluminum material pour and therefore permits an enhanced cooling rate of the second cam bearing surface 110 to a crystalline material depth 112 which creates enhanced mechanical properties of the second cam bearing surface 110. Due to the crystalline material depth 112 of the second cam bearing surface 110, as the second cam bearing surface 110 is subsequently machined to be parallel with the horizontal plane 108 and to accept a bearing journal the enhanced mechanical properties of the second cam bearing surface 110 are retained.

Referring to FIG. 6 and again to FIGS. 1 through 5, according to several aspects a cam bore sand core with metal chills 114 is modified from the cam bore sand core with metal chills 22 to extend lengths of a third metal chill 116 and an oppositely directed fourth metal chill 118 such that the third metal chill 116 and the fourth metal chill 118 in combination extend for substantially an entire length of the camshaft bore 20 of the as-cast engine block 12. The third metal chill 116 includes an outward directed body portion 120, a central body portion 122 directly connected to the outward directed body portion 120 via a first connecting body portion 124, and an inward directed body end 126 directly connected by a second connecting body portion 128 to the central body portion 122. A metal material such as iron, steel, or other alloys used for the third metal chill 116 creates crystalline material depths of the aluminum material present at a first cam bearing surface 130 directly contacting the outward directed body portion 120, a cam bearing surface 132 directly contacting the central body portion 122, and a cam bearing surface 134 directly contacting the inward directed body end 126.

Similar to the third metal chill 116 the fourth metal chill 118 includes an outward directed body portion 136, a central body portion 138 directly connected to the outward directed body portion 136 via a first connecting body portion 140, and an inward directed body end 142 directly connected by a second connecting body portion 144 to the central body portion 138. A metal material such as iron, steel or other alloys used for the fourth metal chill 118 creates crystalline material depths of the aluminum material present at a fourth cam bearing surface 146 directly contacting the outward directed body portion 136, a cam bearing surface 148 directly contacting the central body portion 138, and a portion of the cam bearing surface 134 directly contacting the inward directed body end 142.

According to several aspects the inward directed body end 126 and the inward directed body end 142 may directly contact each other, or a gap 150 may be provided between the inward directed body end 126 and the inward directed body end 142. After the aluminum material cools in the mold, the third metal chill 116 is removed from the as-cast engine block 12 in a direction 152 and the fourth metal chill 118 is removed from the as-cast engine block 12 in a direction 154 oppositely directed with respect to the direction 152. Similar to the cam bore sand core with metal chills 22, sand cores are provided for the cam bore sand core with metal chills 114. A first sand core 156 surrounds the first connecting body portion 124 and a second sand core 158 surrounds the second connecting body portion 128 of the third metal chill 116. A fourth sand core 160 surrounds the second connecting body portion 144 of the fourth metal chill 118 and a third sand core 162 surrounds the first connecting body portion 140. According to several aspects, any or all of the metal chills of the present disclosure may be solid, or may include a bore 156, therefore making the metal chills hollow for all or a portion of a length of the metal chills.

Figure 4:
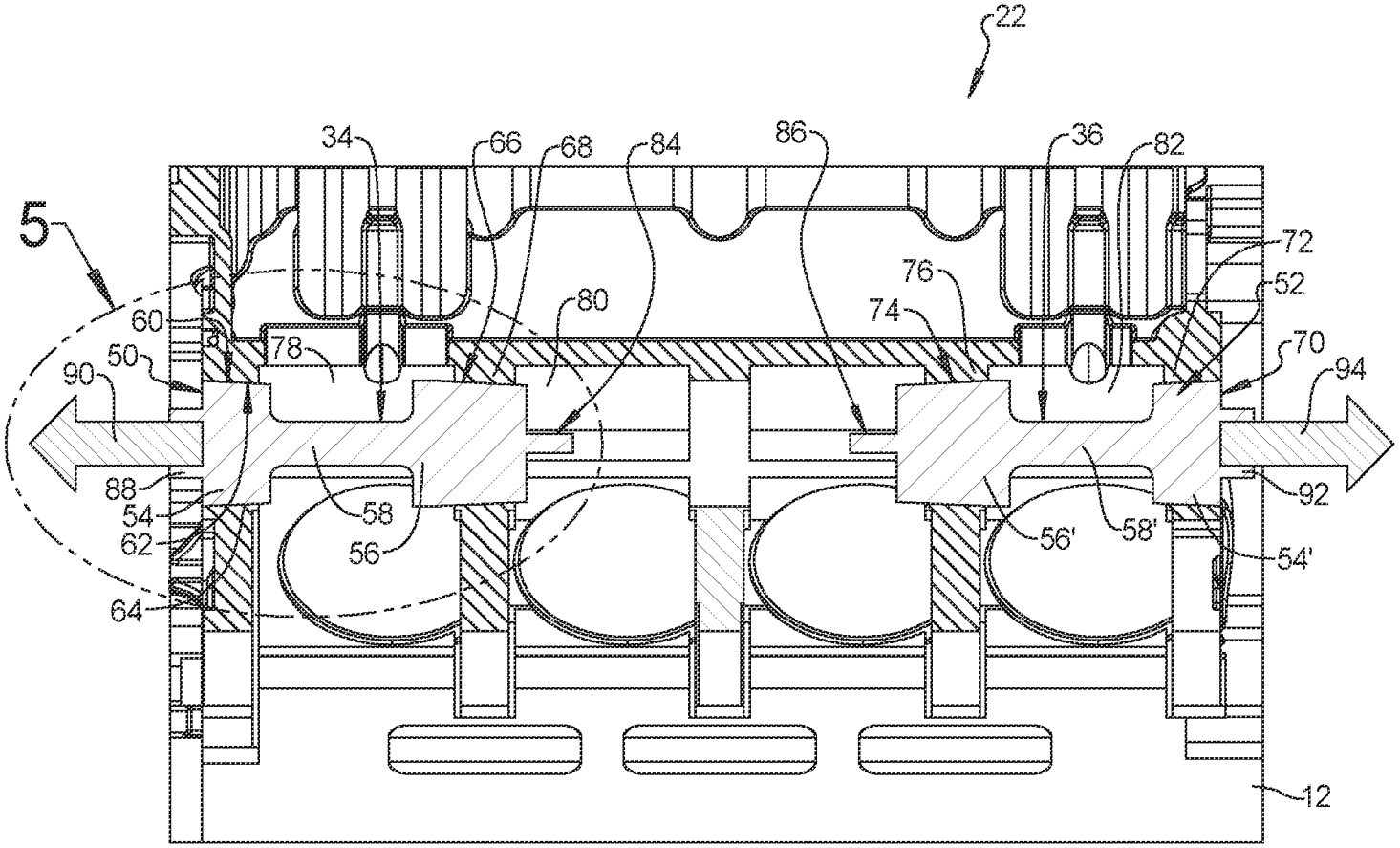
FIG. 4 is a cross sectional view taken at section 4 of FIG. 1.
Figure 5:
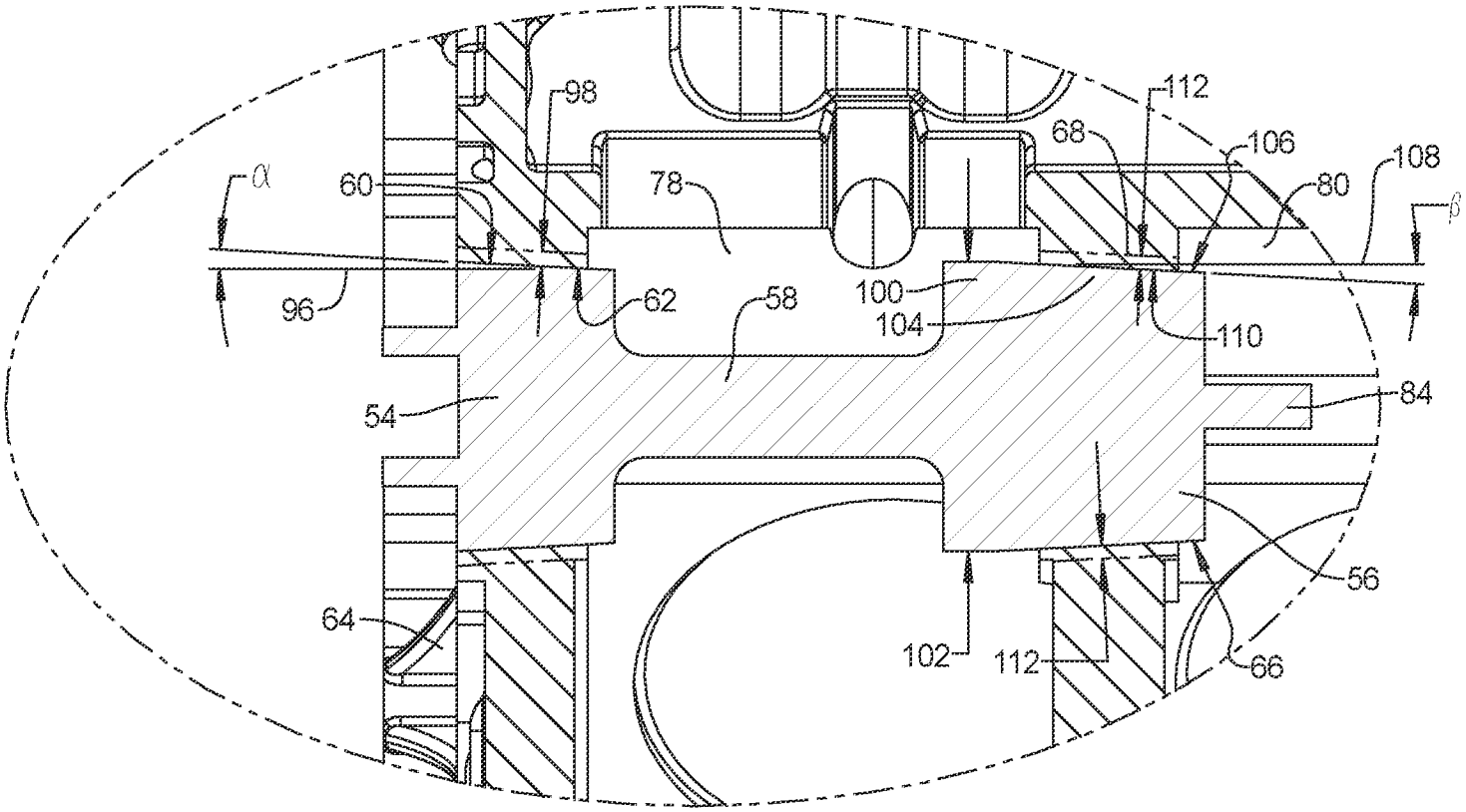
FIG. 5 is a cross sectional view of area 5 of FIG. 4.
Figure 6:
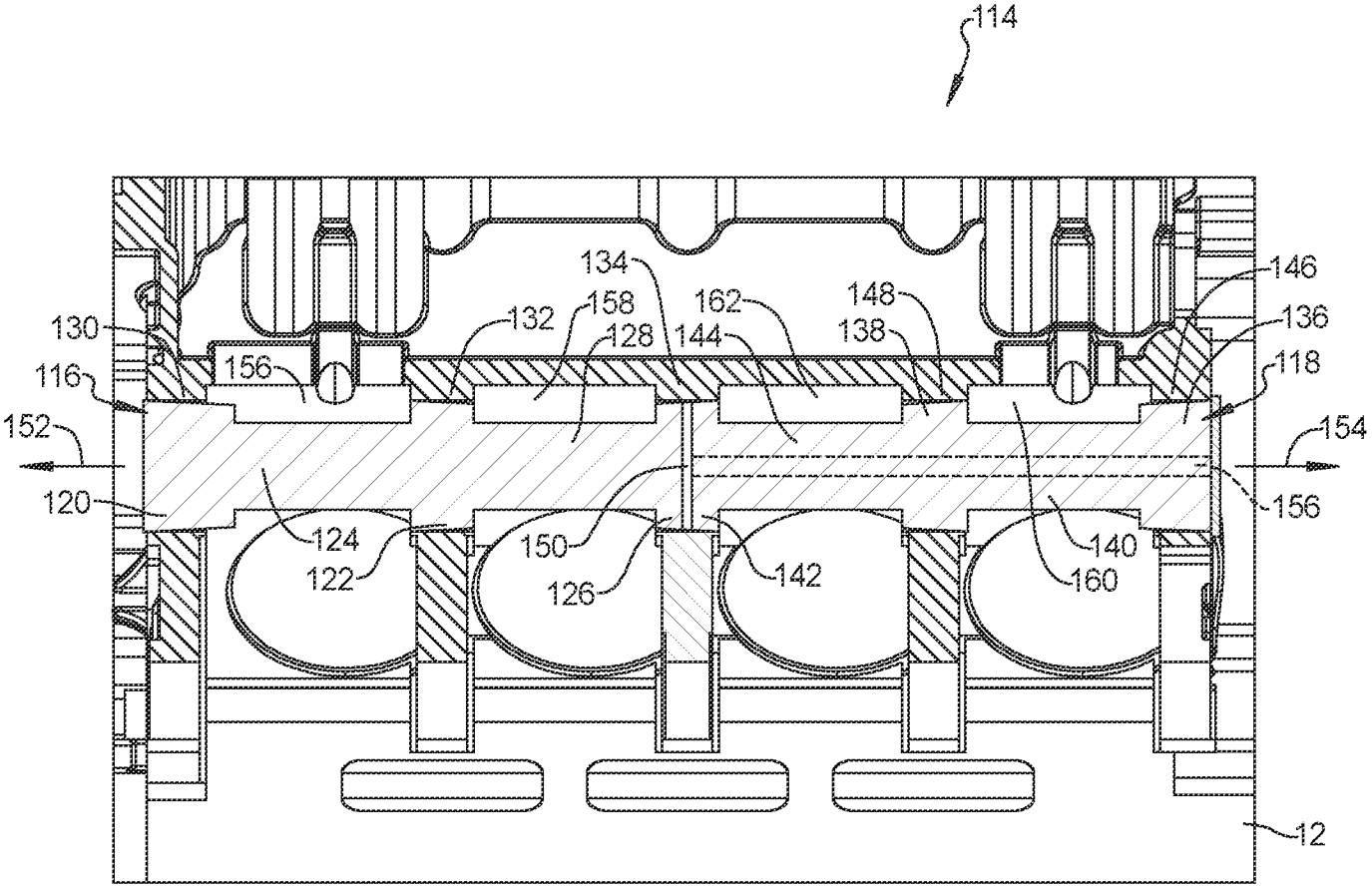
FIG. 6 is cross sectional view similar to FIG. 4 of another aspect of the present disclosure.

With continuing reference to FIGS. 4, 5 and 6, the metal chills of the present disclosure, including the first metal chill 34, the second metal chill 36, the third metal chill 116 and the fourth metal chill 118 are made of a material having a high coefficient of thermal transfer, and preferably with a melting point above the melting point of aluminum. The metal chills of the present disclosure may therefore be provided of a metal such as but not limited to iron, steel or other alloys. This material selection for the metal chills permits localized rapid cooling of the aluminum material at the cam bearing surfaces in direct contact with the metal chills after aluminum pour into the engine block mold, with consequent formation of the crystalline material depths at the cam bearing surfaces described herein.

A system and method for making a hybrid cam bore sand core with metal chills for a cast aluminum engine block 10 of the present disclosure adds chills to the block or crankcase which are embedded in the cam core to improve the aluminum micro-structure in high stress transition areas between the cam tunnel and bulkheads. Metal chills of the present disclosure are positioned in the cam core to improve the aluminum material properties near a bottom of the cam tunnel which transitions into the bulkhead, which is a high stress region in a V8 cylinder block.

The metal chills of the present disclosure may be applied to all cam journals of the engine block. The metal chills may be single piece or multiple pieces. Metal chill materials can be ductile or cast iron, steel, or other alloys. The metal chills may be solid or may also be hollow.

A system and method for making a hybrid cam bore sand core with metal chills for a cast aluminum engine block 10 of the present disclosure offers several advantages. These include provision of a hybrid cam bore sand core with metal chills to increase local cooling rate during solidification and to improve mechanical properties of the cast aluminum in areas below the cam tunnel. The metal chills directly contact surfaces of the cam bore bearing journals. The configuration including angled surfaces of the metal chills of the present disclosure promote easy removal after casting solidification and casting sand shakeout.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A hybrid cam bore sand core with metal chills system for an aluminum engine block, the system comprising:

a camshaft bore extending through a to be cast aluminum engine block;

a cam bore sand core with at least one metal chill positioned within the camshaft bore during casting of the aluminum engine block; and a body portion of the at least one metal chill positioned in direct contact with a cam bearing surface of at least one cam bearing member during casting of the aluminum engine block to increase a cooling rate of the at least one cam bearing member and create a crystalline material depth of the at least one cam bearing member.

2. The system of claim 1, wherein the at least one metal chill defines a first metal chill and a second metal chill individually having an outward directed body portion, an inward directed body end, and a connecting body portion positioned between the inward directed body end and the outward directed body portion.

3. The system of claim 2, wherein the outward directed body portion includes a first tapering surface positioned to directly contact the cam bearing surface of a first one of the at least one cam bearing member.

4. The system of claim 3, wherein the inward directed body end includes a second tapering surface directly contacting the cam bearing surface of a second one of the at least one cam bearing member.

5. The system of claim 4, wherein the first tapering surface defines a first angle oriented with respect to a horizontal plane and the second tapering surface defines a second angle oriented with respect to a second horizontal plane.

6. The system of claim 2, wherein the connecting body portion includes a diameter smaller than an inward directed body diameter and an outward directed body diameter.

7. The system of claim 2, further including a first sand core surrounding the connecting body portion of the first metal chill and a second sand core surrounding the connecting body portion of the second metal chill.

8. The system of claim 7, further including a first extension member integrally created on the inward directed body end of the first metal chill and a second extension member integrally created on the inward directed body end of the second metal chill.

9. The system of claim 8, further including a third sand core positioned between the first metal chill and the second metal chill, the first extension member embedded in and retaining the third sand core in direct contact with the inward directed body end of the first metal chill during molding, and the second extension member embedded in and retaining the third sand core in direct contact with the inward directed body end of the second metal chill during molding.

10. The system of claim 2, wherein the first metal chill is removed from the camshaft bore after casting in a first direction and the second metal chill is removed from the camshaft bore in a second direction opposite to the first direction.

11. A hybrid cam bore sand core with metal chills system for an aluminum engine block, the system comprising:

a camshaft bore extending through a to be cast aluminum engine block;

a cam bore sand core with a first metal chill and a second metal chill positioned within the camshaft bore during casting of the aluminum engine block; and a body portion of the first metal chill positioned in direct contact with a cam bearing surface of a first cam bearing member during casting of the aluminum engine block and a body portion of the second metal chill positioned in direct contact with a cam bearing surface of a second cam bearing member during casting of the aluminum engine block, the first metal chill and the second metal chill provided of a metal to increase a cooling rate of an aluminum material and create a crystalline material depth of the first cam bearing member and the second cam bearing member; and wherein the body portion of the first metal chill includes a first tapering surface and the body portion of the second metal chill includes a second tapering surface, the first tapering surface and the second tapering surface allowing sliding removal of the first metal chill in a first direction and sliding removal of the second metal chill in a second direction opposite to the first direction.

12. The system of claim 11, wherein the first metal chill and the second metal chill individually include an inward directed body end and a connecting body portion positioned between the inward directed body end and the body portion.

13. The system of claim 12, wherein the inward directed body end includes a third tapering surface defining an angle.

14. The system of claim 11, wherein the first metal chill and the second metal chill further include a central body portion directly connected to the body portion via a first connecting body portion and an inward directed body end integrally connected to the central body portion by a second connecting body portion.

15. The system of claim 14, wherein the inward directed body end of the first metal chill is in direct contact with the inward directed body end of the second metal chill.

16. The system of claim 14, wherein the inward directed body end of the first metal chill is separated from the inward directed body end of the second metal chill by a gap.

17. The system of claim 14, wherein the inward directed body end of the first metal chill and the inward directed body end of the second metal chill are in direct contact with a portion of a cam bearing surface of a third cam bearing member.

18. A method for making a cast aluminum engine block using a cam bore sand core with metal chills, comprising:

preparing an engine block mold negative having a first sand core;

positioning a second sand core with at least one metal chill within a camshaft bore of the first sand core; and casting an engine block from an aluminum material using the engine block mold negative having a body portion of the at least one metal chill in direct contact with a cam bearing surface of at least one cam bearing member during casting of the engine block to increase a cooling rate of the at least one cam bearing member and to create a crystalline material depth of the at least one cam bearing member.

19. The method of claim 18, further including forming the at least one metal chill as a first metal chill and a second metal chill further individually having an inward directed body end and a connecting body portion positioned between the inward directed body end and the body portion.

20. The method of claim 18, further including forming the at least one metal chill as a first metal chill and a second metal chill further individually having a central body portion directly connected to the body portion via a first connecting body portion and an inward directed body end integrally connected to the central body portion by a second connecting body portion.

* * * * *